US006786199B2

(12) United States Patent
Oda et al.

(10) Patent No.: US 6,786,199 B2
(45) Date of Patent: Sep. 7, 2004

(54) HYDROCARBONS EMISSION PREVENTIVE APPARATUS IN INTAKE SYSTEM FOR INTERNAL COMBUSTION ENGINE AND METHOD THEREOF

(75) Inventors: Kouichi Oda, Kariya (JP); Masaki Takeyama, Okazaki (JP); Naoya Kato, Ama-gun (JP); Yoshinori Inuzuka, Okazaki (JP); Takashi Nishimoto, Toyota (JP)

(73) Assignees: Toyoda Boshoku Corporation, Kariya (JP); Nippon Soken, Inc., Nishio (JP)

( * ) Notice: Subject to any disclaimer, the term of this patent is extended or adjusted under 35 U.S.C. 154(b) by 157 days.

(21) Appl. No.: 10/205,301

(22) Filed: Jul. 26, 2002

(65) Prior Publication Data

US 2003/0024506 A1 Feb. 6, 2003

(30) Foreign Application Priority Data

Aug. 1, 2001 (JP) ..... 2001-233899

(51) Int. Cl.[7] ..... F02D 9/08; F02M 35/024

(52) U.S. Cl. ..... 123/399; 123/442; 123/518

(58) Field of Search ..... 123/198 R, 198 D, 123/361, 396, 399, 442, 336, 337, 518

(56) References Cited

U.S. PATENT DOCUMENTS

| | | | | |
|---|---|---|---|---|
| 5,092,298 A | * | 3/1992 | Suzuki et al. | 123/399 |
| 6,345,604 B1 | * | 2/2002 | Ahrns et al. | 123/361 |
| 6,701,891 B2 | * | 3/2004 | Niki et al. | 123/396 |

FOREIGN PATENT DOCUMENTS

| | | |
|---|---|---|
| JP | 63-157228 | 6/1988 |
| JP | A 2001-82186 | 3/2001 |

* cited by examiner

*Primary Examiner*—Tony M. Argenbright
(74) *Attorney, Agent, or Firm*—Oliff & Berridge, PLC

(57) ABSTRACT

A throttle valve is opened after stopping an engine to prevent the valve from sticking. Then, when a temperature of the valve has become lower than the polymerization temperature, the valve is closed to seal the vapor of the HCs in a surge tank downstream. Changes in the temperature of the valve are, for example, estimated based on a temperature of an intake air detected by an intake temperature sensor.

21 Claims, 13 Drawing Sheets

HYDROCARBONS EMISSION PREVENTIVE APPARATUS IN INTAKE SYSTEM FOR INTERNAL COMBUSTION ENGINE AND METHOD THEREOF

INCORPORATION BY REFERENCE

The disclosure of Japanese Patent Application No. 2001-233899 filed on Aug. 1, 2001 including the specification, drawings and abstract is incorporated herein by reference in its entirety.

BACKGROUND OF THE INVENTION

1. Field of Invention

The invention relates to an apparatus that prevents hydrocarbons (HCs) of fuel or the like from being emitted outside from an intake system of an internal combustion engine (engine) and a method thereof.

2. Description of Related Art

Recently, from an environmental conservation point of view, a trend to reduce the HCs, which are emitted from an internal combustion engine mounted on a vehicle, have been increasing. Various studies have been made on unburned HCs that are emitted outside together with exhaust emissions and on HCs that evaporate from a fuel supply system such as a fuel tank and leaks outside. However, it is necessary to also pay attention to the HCs that flow outside through an air intake path of the intake system when the internal combustion engine is stopped. HCs that flow out from the intake system include HCs of unburned fuel ("an intake port wet", "an cylinder wet" or the like) that is adhered to a wall surface of the inside of the intake port and/or a cylinder in the form of an oil film during operation of the internal combustion engine and the HCs of fuel, engine oil or the like contained in blowby gas that is recirculated to the intake system by a positive crankcase ventilation (PCV: compulsory air ventilation in crankcase) system. It is necessary to prevent these HC gases from leaking outside of the vehicle through the air cleaner or the like diffusing within the intake path after the internal combustion engine is stopped.

As one of the countermeasures against the problem above, it is proposed in Japanese Utility Model Laid-Open No. 63-157228 that a filter element containing activated carbon is formed by laying filter paper and activated carbon paper capable of adsorbing the HCs and folding them in bellows, and the filter element is mounted in place of an ordinary air cleaner element within an air cleaner provided in the intake path of an internal combustion engine.

However, in a filter element, which contains activated carbon as described above, when an amount of the activated carbon is increased, air flow resistance is increased resulting in an increased pressure loss. Accordingly, since a problem of an output decrease of the engine occurs, it is impossible for the filter element to carry a large amount of activated carbon. Consequently, since only a small amount of HCs is adsorbed by the activated carbon, when the fuel, which forms an oil film-like intake port wet and cylinder wet, absorbs residual heat of the internal combustion engine after the internal combustion engine is stopped, the fuel, in a form of a large amount of HC, evaporates and flows to the filter element at once. Then, the activated carbon is saturated and cannot adsorb the HCs any more. As a result, there is a possibility that HCs, that were not adsorbed, will flow out through an air intake path of the air cleaner.

Therefore, as a countermeasure against the problem above, it is necessary to prevent a large amount of HCs, which evaporates from the intake port wet and the cylinder wet, from reaching the filter element containing activated carbon by always fully closing a throttle valve disposed downstream of the filter element while the internal combustion engine is stopped (also by closing an idle speed control valve (ISCV) that bypasses the throttle valve if it is provided,) with an exception of a small amount of HCs, which leaks upstream through a narrow gap between the throttle valve and the surrounding throttle body. Since, in many internal combustion engines, the throttle valve is fully closed while the engine is stopped, this problem does not seem very critical.

However, in a case where the throttle valve is kept in a fully closed state when the internal combustion engine is stopped, the HCs contained in blowby gas, which is recirculated to the intake system by the PCV system during operation of the internal combustion engine, are likely to accumulate in a liquid state in a narrow gap of the fully closed throttle valve. It may be assumed that the above is caused by the capillarity. Further, since the blowby gas contains tar components and fine particles of carbon, the viscosity of the liquid HCs accumulated in the gap of the throttle valve is higher than the viscosity of the light fuel may be assumed as another cause.

When heat of the internal combustion engine, which is in a state of, so-called "dead soak" after the engine is stopped, is transmitted up to the periphery of the throttle valve. In addition, the temperature of the gap is increased, molecules of the HCs adhered to the gap of the throttle valve around the thus closed throttle valve are polymerized into a high polymer by the heat, resulting in a tar-like deposit having a high viscosity. Consequently, the throttle valve is stuck to the throttle body, thus preventing free movement. When this event is repeated, and when the throttle valve gets into a fixed state, not only the valve hardly works smoothly but a problem may occur that the valve opens suddenly, causing a rapid increase in the rotation speed of the internal combustion engine when a strong operating force is applied thereto.

SUMMARY OF THE INVENTION

The invention thus provides an apparatus and method that reduces the possibility of sticking of a throttle valve, and effectively prevent the HCs from leaking to the outside of a vehicle from an intake system without the need to increase the amount of the activated carbon as the air flow resistance.

The invention utilizes a time lag between a period of time that the HCs adhered to the throttle valve is heated and polymerized, and a period of time that the fuel adhered in a form of oil film to a wall surface of an intake port or a cylinder of the internal combustion engine evaporates and reaches the air cleaner. That is to say, the aforementioned problem is solved by opening the throttle valve after the internal combustion engine is stopped so as to prevent the HCs adhered to the gap of the throttle valve from being polymerized by heat and sticking the gap, and further by closing the throttle valve after the temperature around the throttle valve has been decreased to a level that the polymerization reaction of the HCs does not occur so as to seal the vapor of the HCs downstream of the throttle valve.

The first aspect of the invention relates to a hydrocarbons emission preventive apparatus in the intake system of the internal combustion engine. The apparatus includes a first throttle valve provided in the intake path and a controller that opens the first throttle valve after the internal combustion engine is stopped, keeps the valve open from a point of time when the throttle valve is opened until a predetermined condition is met where substantially no polymerization occurs by the hydrocarbons on at least one of the first throttle valve and the intake path surrounding the first throttle valve and closes the first throttle valve when the predetermined condition is met. Accordingly, for example, because it is possible to keep the throttle valve open for a predetermined period of time (for example, a period of time of 60 minutes or less) during which the HCs contained in the blowby gas and adhered to the gap of the throttle valve are polymerized by heat transmitted from a high temperature portion of the internal combustion engine after operation thereof is stopped, it is possible to prevent the throttle valve from sticking to the valve body by the polymerized HCs. When the period of time has passed, because the heat transmitted to the periphery of the throttle valve diffuses and the temperature around the throttle valve is also decreased, even when the throttle valve is closed, the problem of sticking does not occur.

Further, although the HCs evaporate from the oil-film like fuel adhered to the inside of a combustion chamber and an intake port, and diffuse upstream in the intake path after the internal combustion engine is stopped, it takes a considerably long period of time for the HCs to reach the throttle valve, and an inlet portion of the intake path such as an air cleaner provided further upstream. Accordingly, for example, even when the throttle valve is opened for a predetermined period of time as described above in order to avoid sticking of the throttle valve due to polymerization of the HCs after the internal combustion engine is stopped, the vapor of the HCs does not flow up to a position of the throttle valve. Therefore, by closing the throttle valve again after opening it for a predetermined period of time, it is possible to prevent the HCs that evaporated from flowing outside through the air intake path by sealing the HCs within a surge tank downstream of the throttle valve.

A second aspect of the invention relates to a method for preventing emission of hydrocarbons from being emitted through an intake path of the internal combustion engine. The method includes the steps of opening a throttle valve provided in the intake path after stopping the internal combustion engine, keeping the throttle valve open from a point of time when the throttle valve is opened until a predetermined condition is met where substantially no polymerization occurs by the hydrocarbons on at least one of the first throttle valve and the intake path surrounding the first throttle valve and closing the first throttle valve when the predetermined condition is met.

BRIEF DESCRIPTION OF THE DRAWINGS

The foregoing and further objects, features and advantages of the invention will become apparent from the following description of preferred exemplary embodiments with reference to the accompanying drawings, wherein like numerals are used to represent like elements and wherein.

DETAILED DESCRIPTION OF PREFERRED EMBODIMENTS

As a result of the experiments and examinations, the inventors discovered the following facts. That is, HCs adhered to the throttle valve are heated and polymerized only within a period of time of 60 minutes or less after the internal combustion engine is stopped, although the period of time slightly varies depending on a distance between a high temperature portion and a throttle valve of the internal combustion engine and a level of heat capacity or the like of the internal combustion engine. In addition, after the period of time has passed, a polymerization reaction of the HCs does not occur due to a decreased temperature.

Also, it was found that it takes a longer period of time than previously expected, for the fuel adhered in a form of oil film to a wall surface of an intake port and a cylinder of an internal combustion engine, to absorb heat of the high temperature portion of the internal combustion engine, evaporate and flow upstream in the intake system and finally to reach an air cleaner, although the time varies slightly depending on the length, shape, and the sectional area of the intake path. The reason why it takes a long period of time for the HCs to reach the air cleaner is assumed that, even in a case of light fuel like gasoline, because the molecular weight of most of the HCs including the fuel is larger than that of the air, and a position of the air cleaner is, as normally, slightly higher than that of the internal combustion engine main body, it takes a long time for the HCs to rise while diffusing into the air in the intake path.

Hereinafter, a particular hydrocarbons emission preventive apparatus and the method thereof will be described with reference to exemplary embodiments.

Figure 1A:
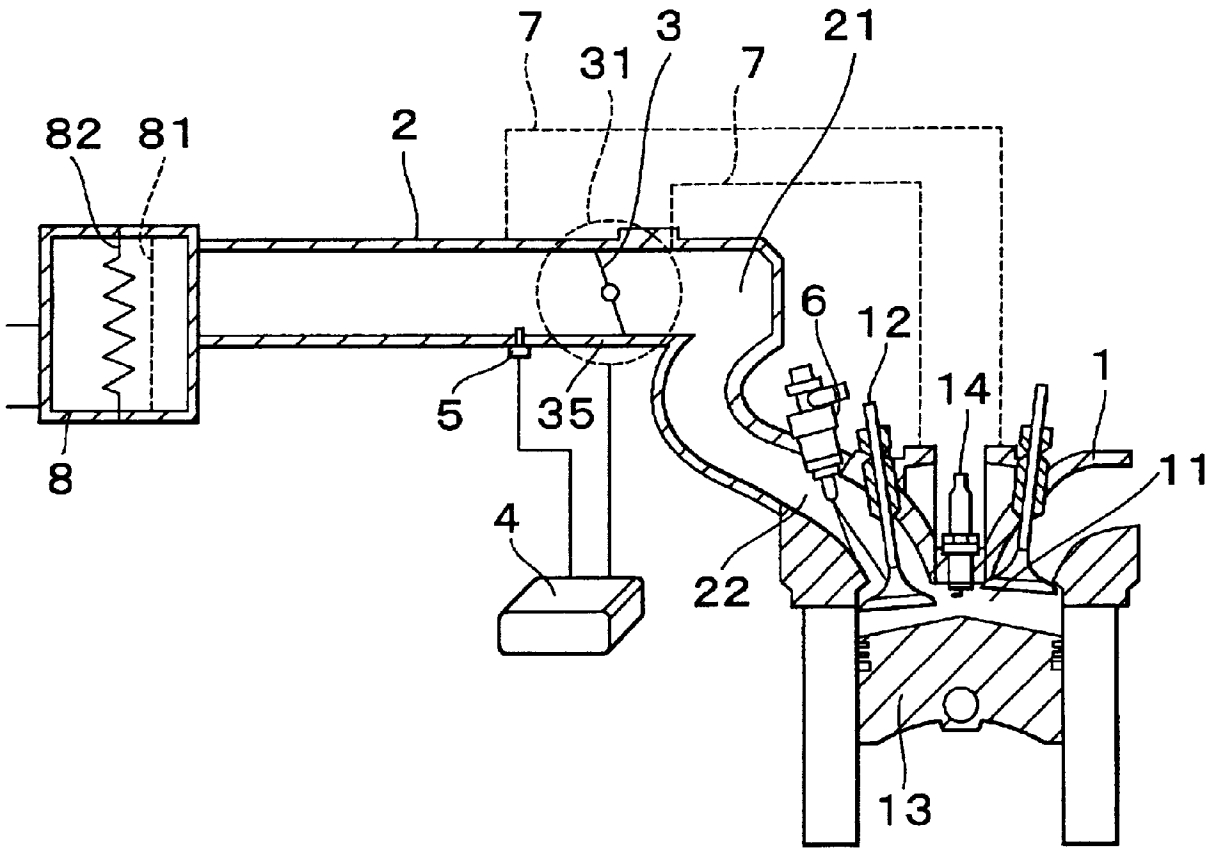
FIG. 1A is a sectional view showing the structure of a hydrocarbons emission preventive apparatus according to the first exemplary embodiment.

FIG. 1A shows the first exemplary embodiment of the invention. In the example, a throttle valve 3 is provided in an intake pipe 2 of an engine 1 which is an inlet port injection type gasoline engine, and the throttle valve 3 is structured so as to be automatically opened/closed according to a command from an electronic control unit (ECU) 4. To accomplish this, a motor 31, which is roughly indicated by a broken line, is provided to a rotation shaft of the throttle valve 3. In the first exemplary embodiment, at least a signal of an intake temperature sensor 5 for detecting a temperature of an intake air of the engine 1 is input to the ECU 4. The intake temperature sensor 5 in the first exemplary embodiment is attached to the intake pipe 2 immediately before the throttle valve 3. As for the intake temperature sensor 5, it is not necessary to provide any special one. Instead, a signal detected by an intake temperature sensor which may be provided in an ordinary engine may be utilized. This is because of a certain correlation between the temperature of the intake air detected at a desired position of the intake system and the temperature at the periphery of the throttle valve. Accordingly, in the first exemplary embodiment, in place of directly detecting the temperature of the throttle valve 3 itself, the temperature of the throttle valve 3 is estimated based on the temperature of the intake air passing the throttle valve 3 detected by the intake temperature sensor 5.

Figure 1B:
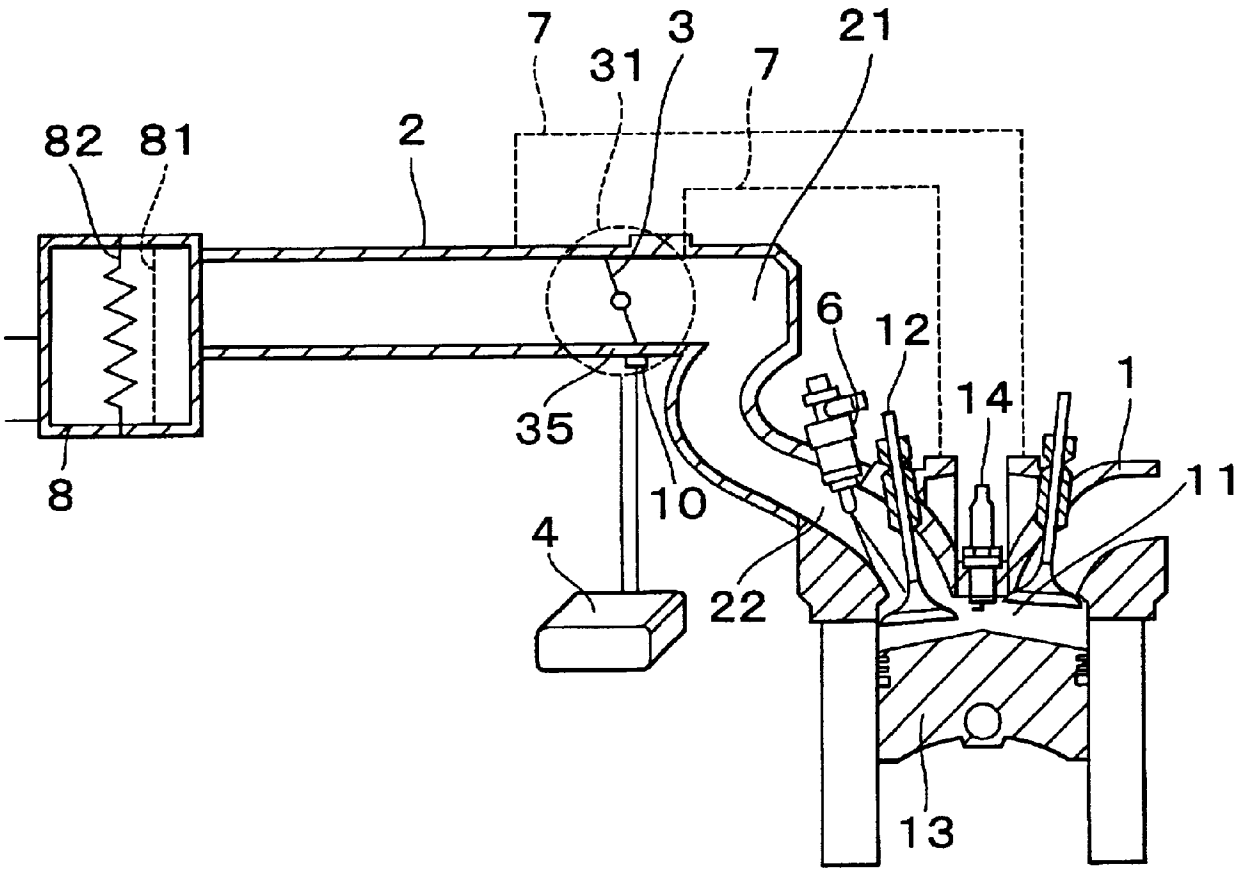
FIG. 1B is a sectional view showing a modification of the first exemplary embodiment provided with a temperature detector in a throttle body.

In a case, as shown in FIG. 1B, where a temperature sensor 10 is provided in the throttle valve 3 itself or a throttle body 35 surrounding it and the temperatures of them are directly detected, the detected values thereof are input to the ECU 4.

The intake pipe 2 downstream of the throttle valve 3 is enlarged to form a surge tank 21 which has a relatively large capacity. Further, a plurality of intake ports 22 branch and extend to an intake valve 12 of each cylinder from the surge tank 21. To the intake port 22, each cylinder is provided with an injector 6 that is opened for a period of time instructed by the ECU 4 to inject the fuel (gasoline) into the intake port 22.

Although different from the exemplary embodiment shown in the figure, the invention is applicable to an engine, that is so-called a "direct-injection engine" in which the injector injects the fuel such as gasoline directly into the inside of a combustion chamber 11 of each cylinder.

Two PCV paths 7, each of which constitutes a part of the PCV systems, are connected upstream and downstream adjacent to the throttle valve 3, and both communicate with the inside of the cylinder head cover (not shown) of the engine 1. Blowby gas is designed to be guided from a crankcase (not shown) to the intake pipe 2 via the PCV paths 7. Accordingly, the blowby gas containing the HCs can be made harmless by being recirculated into the intake pipe 2 adjacent to the throttle valve 3 and being burned inside of the combustion chamber 11 together with the fuel injected from the injector 6.

Figure 12:
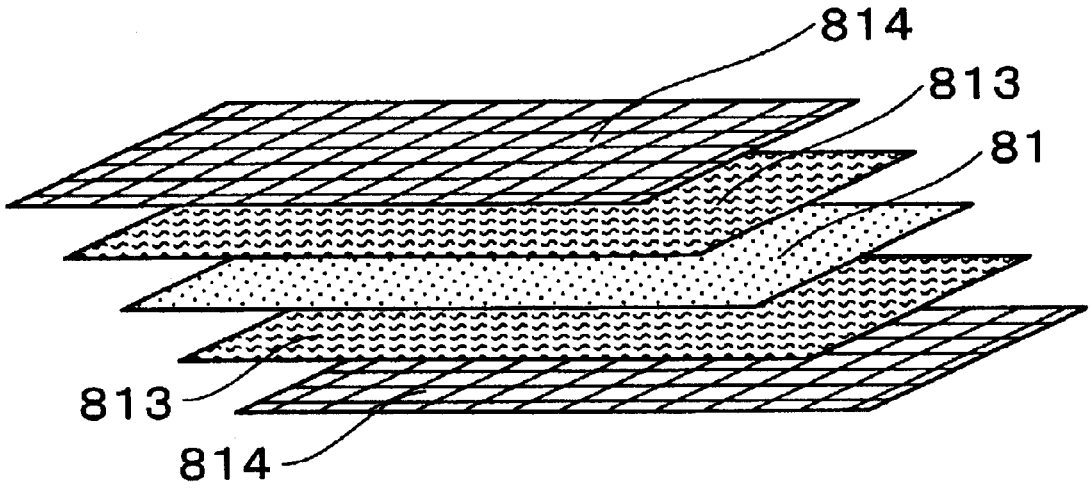
FIG. 12 is an exploded perspective view of a filter element provided with an activated carbon layer.
Figure 13:
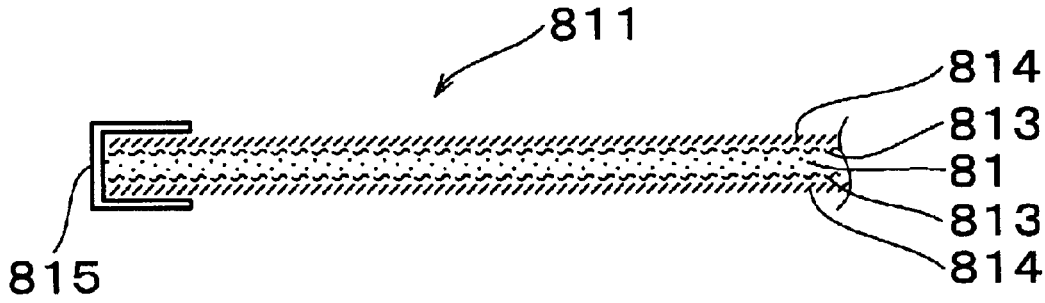
FIG. 13 is a sectional view of the filter element provided with an activated carbon layer.

Upstream of the intake pipe 2, an air cleaner 8 is provided, and an activated carbon layer 81 and an air cleaner element 82 are retained therein so as to cross the air passage. Of course, the two members may be integrated to form a filter element 811 containing activated carbon as shown in FIGS. 12 and 13. In this exemplary embodiment, the activated carbon layer 81 is formed from particles of granulated activated carbon into a thin plate shape by means of an appropriate binder. On both sides of the activated carbon layer 81, breathable non woven fabrics 813 for filtering the air are overlaid, which is further sandwiched by mesh-like cloths 814 to protect them. The rim of the periphery is reinforced by a frame 815 made of polypropylene, and each layer is integrated.

Since the hydrocarbons emission preventive apparatus according to the first exemplary embodiment of the invention is structured as described above, the fuel is injected from the injector 6 at a predetermined timing for a predetermined period of time during operation of the engine 1. While being mixed with the air supplied from the air cleaner 8, the fuel flows into the combustion chamber 11 through the intake port 22 during a period of time when the intake valve 12 is opened, and is compressed by a piston 13 and ignited by an ignition plug 14 to burn.

A part of the fuel injected from the injector 6 is adhered to an inner wall surface of the intake port 22 and portion in the combustion chamber 11 such as a top face of the piston 13 where a temperature is relatively low, forming an oil film of the fuel which is called as an intake port wet or a cylinder wet. Also, blowby gas generated in the crankcase (not shown) or the like is recirculated downstream of the throttle valve 3 through the PCV path 7. The blowby gas contains HCs components including heavy ones and particulates of carbon.

In this state, when the engine 1 is stopped, heat of a high temperature portion of the engine 1, which is in a state of dead soak, is transmitted to a portion where oil film of light fuel such as gasoline is formed. Further, when the temperature of the oil film is increased, the adhered fuel evaporates and diffuses up to the air cleaner 8 through the gap between the throttle body 35 and the throttle valve 3 thereof which is normally closed when the engine is stopped, and through the inside of the intake pipe 2, after a considerably long period of time has passed since the engine 1 is stopped. At the same time, a part of the HCs of the engine oil and the fuel contained in the blowby gas reaches the air cleaner 8 diffusing in the intake pipe 2.

Further, another part of the HCs contained in the blowby gas gather and are adhered to the gap of the periphery of the closed throttle valve 3. When the temperature of the throttle valve 3 is increased by the heat transmitted from the high temperature portion of the engine 1 that is in a state of dead soak, the HCs adhered to the gap is polymerized into a high polymer and the viscosity thereof is increased. Therefore, there is a possibility that the throttle valve 3 is stuck to the throttle body 35.

In order to avoid the aforementioned problem, the hydrocarbons emission preventive apparatus according to the first exemplary embodiment is configured such that the ECU 4 activates the motor 31 to open the throttle valve 3 up to a predetermined degree of opening immediately after the engine 1 is completely stopped, or when a predetermined short period of time has passed after the engine is stopped. Next, when the temperature of the intake air of the engine 1 detected by the intake temperature sensor 5 is decreased to a predetermined value (60–70° C.), the ECU 4 activates the motor 31 again to fully close the throttle valve 3.

Figure 2:
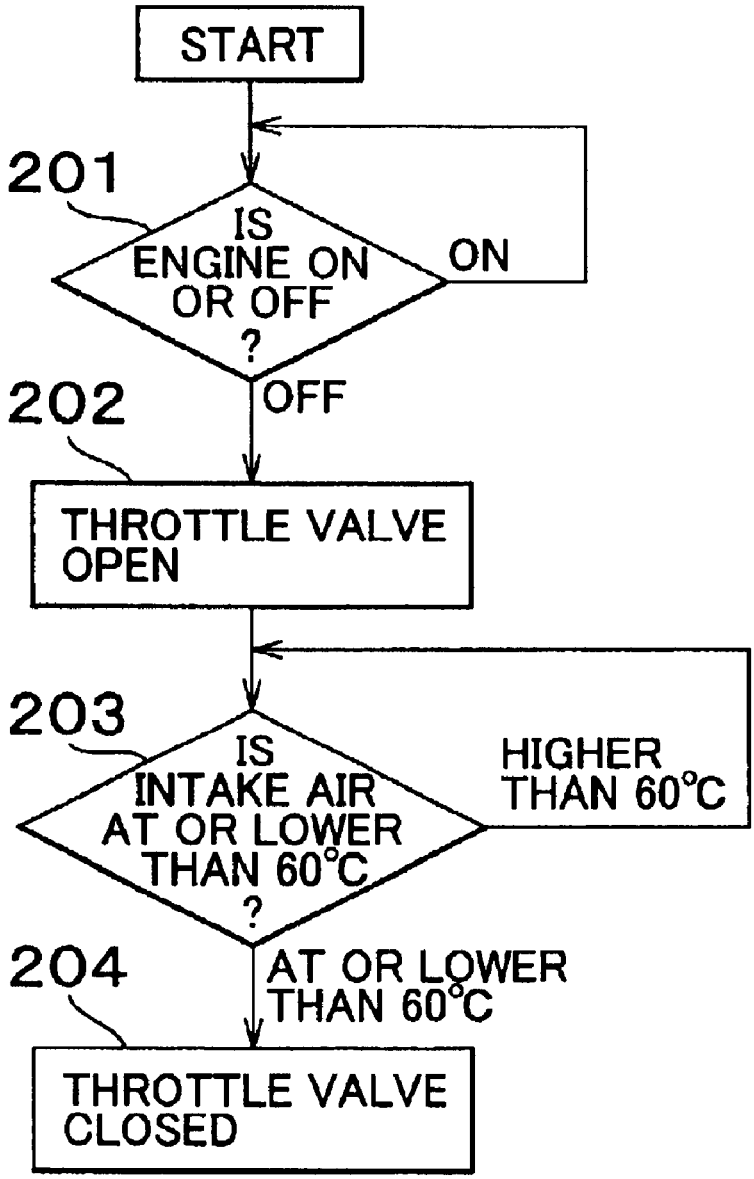
FIG. 2 is a flowchart showing a sequence of control of the first exemplary embodiment.

The control operation of the ECU 4 according to the first exemplary embodiment is automatically performed repeatedly at predetermined intervals (for example, one minute) in accordance with a control program as roughly shown in the flowchart in FIG. 2. That is to say, when the program starts at a "predetermined timing" like a point of time when an operation to stop the engine 1 by turning the key switch (not shown) OFF, for the first time, it is judged whether the engine 1 is in operation in step 201. The judgment can be made by determining whether the detected value of the rotation speed sensor of the engine 1 is 0. Alternatively, the judgment may be made by determining whether the key switch is maintained to the OFF position.

In a case where the engine is still operating (ON), the same judgment is made repeatedly. When it is judged that the engine 1 is stopped (OFF), the process proceeds to the next step 202 to open the throttle valve 3, immediately or after a predetermined short period of time, to a predetermined degree of opening by the motor 31. In the next step 203, in order to estimate whether the temperature of the periphery of the throttle valve 3 has been decreased to the polymerization temperature of the HCs or lower, it is judged whether the detected value of the intake temperature sensor 5 that detects the temperature of the intake air immediately upstream the throttle valve 3 is at or lower than a predetermined temperature, for example, at or lower than 60° C. When the temperature is not at or lower than the predetermined temperature, the same judgment is repeatedly performed. And when it is judged that the temperature has been decreased to the predetermined temperature, the process proceeds to the next step 204 to fully close the throttle valve 3.

As described above, it is found that, even when the engine 1 is stopped, it takes a considerably long period of time for the HCs, constituting the oil film inside the intake port 22 and the combustion chamber 11, to absorb heat transmitted from the high temperature portion and evaporate, and to move upstream diffusing in the intake system. Therefore, by opening the throttle valve 3 up to a point of time just before the HCs pass the throttle valve 3 and flow toward the air cleaner 8, it is possible to prevent the HCs components of the blowby gas, which is likely to accumulate in the gap of the throttle valve 3, from being polymerized in the gap and sticking the throttle valve 3 to the throttle body 35.

Further, by opening the throttle valve 3 after the engine 1 is stopped, because the heat, which is transmitted to the intake system from the high temperature portion, radiates swiftly, it is possible to suppress the evaporation and diffusion of the oil-film like HCs remaining in the intake port 22 and the combustion chamber 11. In addition, because the throttle valve 3 is closed before the evaporated HCs flow up to the position of the throttle valve 3, it is possible to seal most of the HCs, which are remaining in the intake system, within the surge tank 21 downstream of the throttle valve 3. Accordingly, because the amount of the HCs to be adsorbed by the activated carbon layer 81 of the air cleaner 8 is reduced, even when the adsorption capability of the activated carbon layer 81 is small, the amount of HCs that reaches the activated carbon layer 81 will not exceed the adsorption capability thereof Consequently, because the possibility that the HCs flow outside through the air cleaner 8 is reduced, and also, because the air flow resistance of the activated carbon layer 81 is not increased, there is no possibility of decreasing the performance of the engine 1.

As described above, according to the first exemplary embodiment, because the temperature of the throttle valve 3 is estimated based on the temperature of the intake air measured by a temperature detector such as the intake temperature sensor 5, which is provided in an ordinary internal combustion engine in many cases, it is possible to suppress the increase of cost without allowing the structure of the hydrocarbons emission preventive apparatus becoming complicated.

Furthermore, in a case where the temperature sensor 10 is provided in the throttle valve 3 or the throttle body 35, the throttle valve 3 is closed at the timing when the temperature detected by the sensor is decreased to a temperature (for example, 60–70° C.) in which the polymerization of the HCs does not occur after the temperature is once increased.

Figure 3:
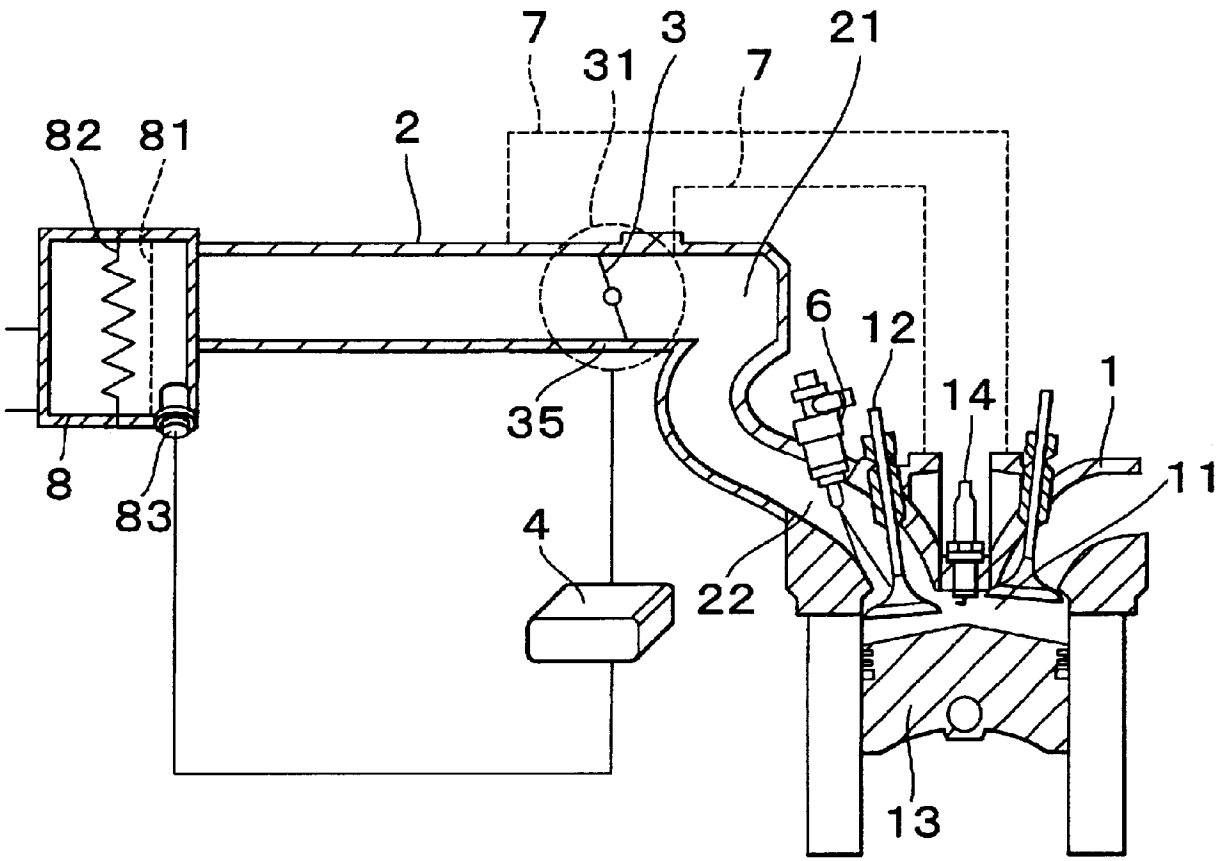
FIG. 3 is a sectional view showing the structure of a hydrocarbons emission preventive apparatus according to the second exemplary embodiment.

FIG. 3 shows the structure of a hydrocarbons preventive apparatus according to the second exemplary embodiment of the invention. The elements that are common to the elements of the aforementioned first exemplary embodiment shown in FIG. 1A are denoted by the same numerals to omit the duplicated description. This will be the same in the description of the exemplary embodiments following the second exemplary embodiment.

Figure 4:
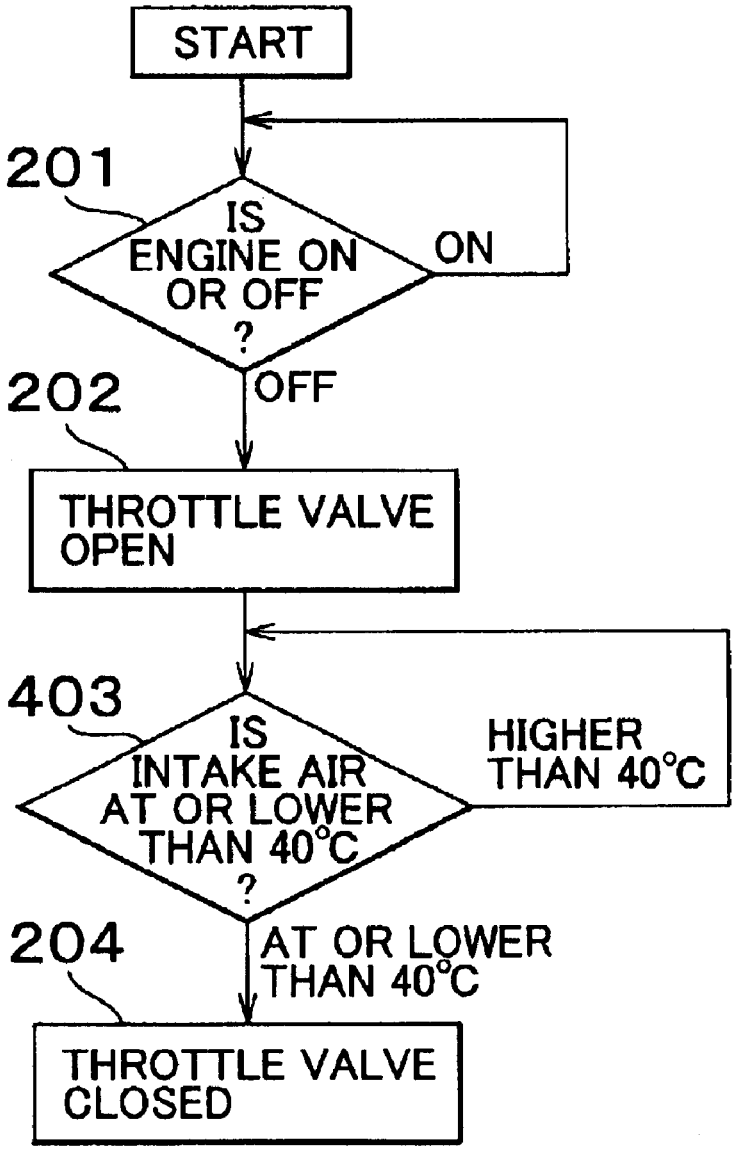
FIG. 4 is a flowchart showing sequence of the control of the second exemplary embodiment.

The second exemplary embodiment is characterized by that an intake temperature sensor 83 is provided in the air cleaner 8 to detect the temperature of the intake air in order to judge the timing when the valve 3, which was opened after the engine 1 is stopped, is closed again, in place of the intake temperature sensor 5 used in the first exemplary embodiment which detects the temperature of the intake air immediately upstream of the throttle valve 3. Next, when the temperature of the intake air detected by the intake temperature sensor 83 is decreased to a predetermined temperature, for example, 40° C., it is estimated that the temperature of the periphery of the throttle valve 3 has been decreased to the polymerization temperature of the HCs or lower, the HCs are sealed within the surge tank 21 by closing the throttle valve 3. The control can be performed with the procedures shown in the flowchart in FIG. 4. The steps, which are common to the steps in the aforementioned flowchart in FIG. 2, will be denoted by the same numerals to omit the duplicated description. Also, in the second exemplary embodiment, in the same manner as the first exemplary embodiment, the control operation is automatically performed repeatedly by the ECU 4 at predetermined intervals (for example, one minute).

In this control, after the throttle valve 3 is opened by the motor 31 up to a predetermined degree of opening in step 202, in the following step 403, in order to estimate whether the temperature at the periphery of the throttle valve 3 has been decreased to the polymerization temperature of the HCs or lower, it is judged whether or not the detected value of the intake temperature sensor 83, which detects the temperature of the intake air within the air cleaner 8, has been decreased to a predetermined temperature, for example, 40° C. or lower. When the temperature has not been decreased to the predetermined temperature or lower, the same judgment is made repeatedly. Then, when it is judged that the temperature has been decreased to the predetermined temperature or lower, the operation proceeds to the next step 204 to fully close the throttle valve 3.

Figure 5:
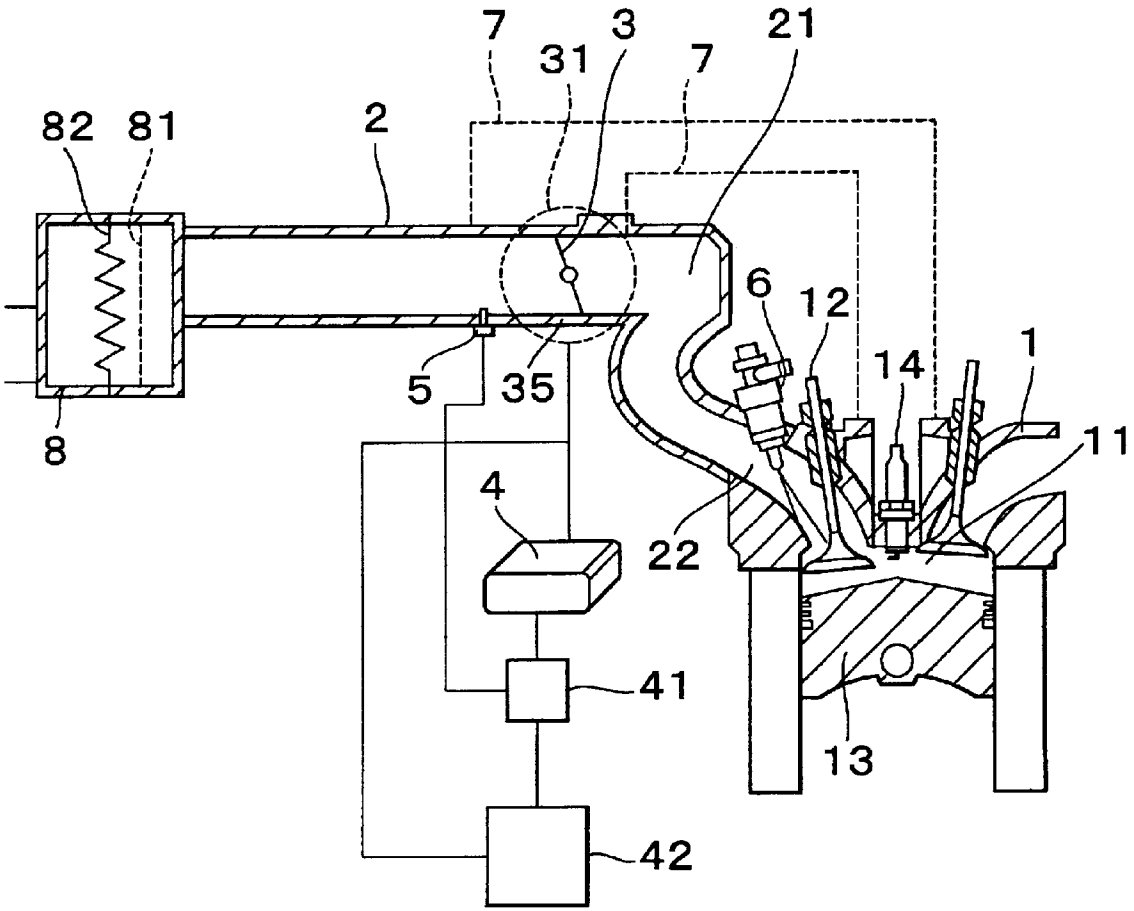
FIG. 5 is a sectional view showing the structure of a hydrocarbons emission preventive apparatus according to the third exemplary embodiment.

FIG. 5 shows the structure of a hydrocarbons preventive apparatus according to the third exemplary embodiment of the invention. A relay 41 is provided in order to open/close a power supply circuit of the ECU 4 when the engine 1 is started or when the engine 1 stopped. A contact, which turns ON at non-operation of the ECU 4 when the power supply circuit of the ECU 4 is turned OFF, is provided within the relay 41. The contact opens/closes selectively the power supply circuit of a valve drive circuit 42 and the power supply circuit of the ECU 4. The contact establishes conductivity between the intake temperature sensor 5 (or, the intake temperature sensor 83, or the like) and the valve drive circuit 42. Further, when the engine 1 is stopped, the throttle valve 3 is opened by driving the motor 31 by means of the valve drive circuit 42, after an elapse of time when the intake temperature sensor 5 detects a temperature at or lower than the predetermined value, the throttle valve 3 is closed again by the valve drive circuit 42. In this case, since the throttle valve 3 is controlled to be opened/closed by the valve drive circuit 42 with a smaller power consumption than the ECU 4, it is possible to reduce the power consumption while the engine 1 is stopped.

In the first to third exemplary embodiments, in order to judge the timing of closing the throttle valve 3 again, which has been opened when the engine 1 is stopped, the intake temperature sensor 5 disposed in the intake pipe 2 immediately upstream of the throttle valve 3, or the intake temperature sensor 83 disposed within the air cleaner 8 is used. However, using a timer provided in the ECU 4 in place of these sensors, for example, the structure may be such that the throttle valve 3 is closed at a timing, i.e., when a time after the engine 1 is stopped and the throttle valve 3 is opened has exceeded a predetermined value. The structure, although not shown, represents the fourth exemplary embodiment and a sequence of control thereof is shown in FIG. 6.

In step 601, in the same manner as aforementioned, it is judged whether the engine 1 is in operation (ON) or stopped (OFF). In this case, when it is judged that the engine 1 is stopped, the process proceeds to step 602 to start an operation-stop timer for measuring an elapsed time after the engine 1 is stopped, and then proceeds to step 603 to open the throttle valve 3. The operation-stop timer is reset during the operation of the engine 1. In the following step 604, it is judged based on the measured value of the timer whether the measured period of time, for example, 60 minutes, in which the temperature of the throttle valve 3 is decreased to the polymerization temperature of the HCs or lower, has passed or not after the engine 1 is stopped. If not passed, the same judgment is made repeatedly. When it is judged that the predetermined time has passed, the process proceeds to step 605 to close the throttle valve 3.

Figure 6:
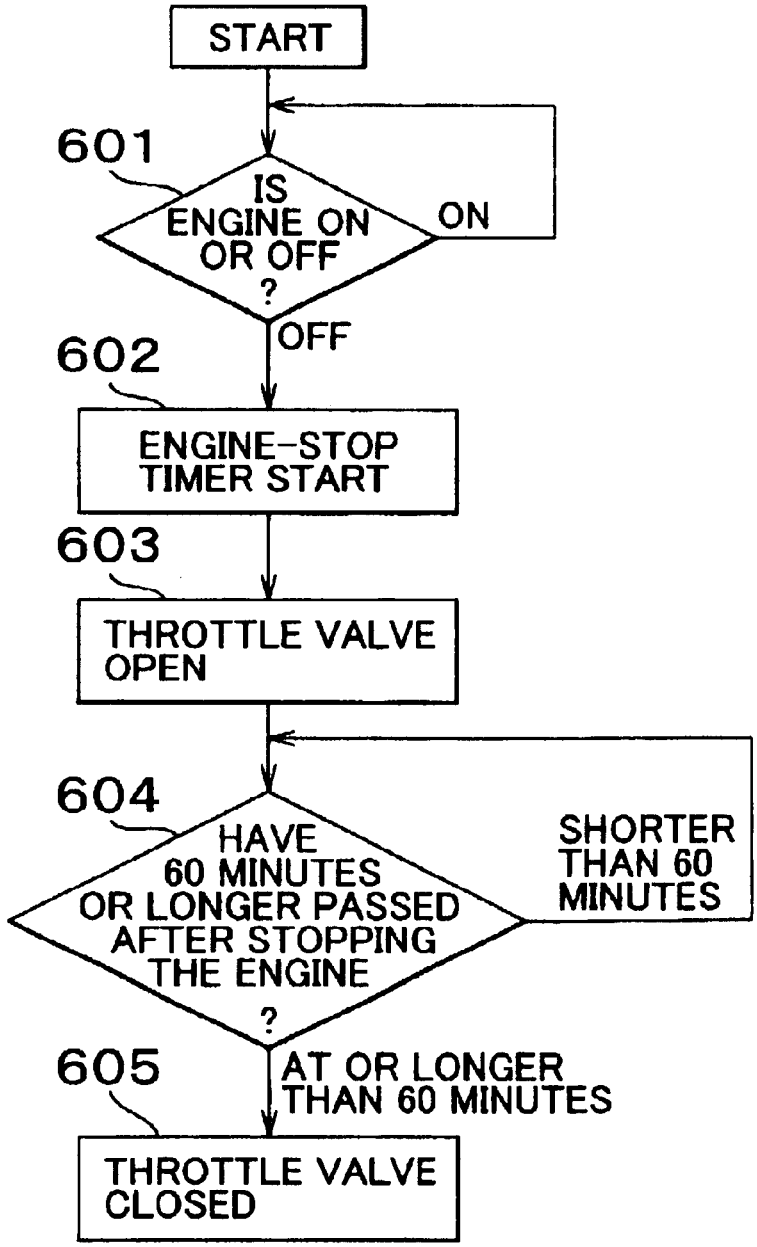
FIG. 6 is a flowchart showing a sequence of control of the fourth exemplary embodiment.

In the control program shown in the flowchart in FIG. 6, judgment operation is performed in step 601 and 604, respectively. However, it is possible to make the control sequence simpler than that of the fourth exemplary embodiment, for example, in place of the processing in step 601, by immediately closing the throttle valve 3 upon recognizing that the engine has been stopped when the key switch of the engine 1 is turned OFF, and/or, in place of the processing in step 604, immediately closing the throttle valve 3 when the counted value of the engine stop-timer reads 60 minutes. Also, a similar control can be performed by means of another simple means without using the ECU 4.

Figure 7:
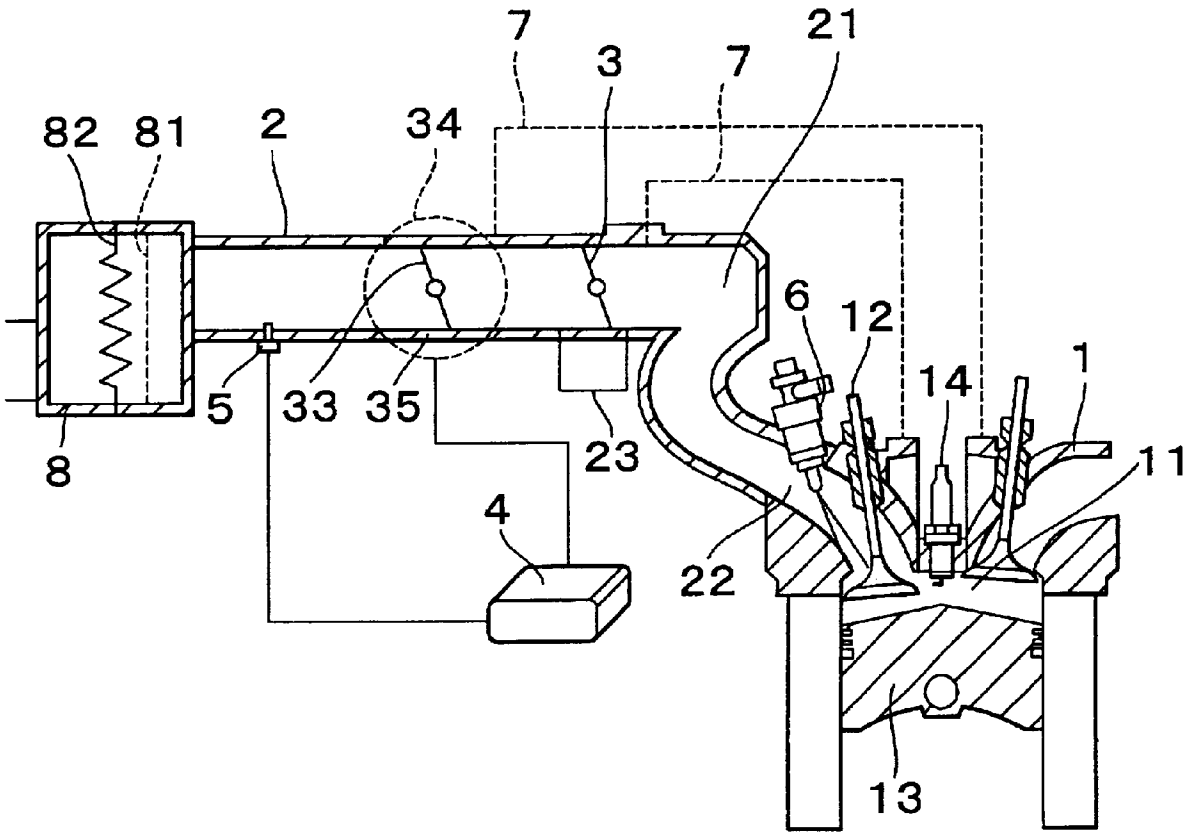
FIG. 7 is a sectional view showing the structure of a hydrocarbons emission preventive apparatus according to the fifth exemplary embodiment.

FIG. 7 shows the structure of a hydrocarbons preventive apparatus according to the fifth exemplary embodiment of the invention. In this case, another throttle valve 33 upstream of the throttle valve 3 is provided in the intake pipe 2 which is further upstream of the position where the PCV paths 7 are opened, and is controlled to be opened/closed by the ECU 4 via a motor 34. The throttle valve 33 is controlled in the same manner as the throttle valve 3 in the aforementioned exemplary embodiments. A known idle speed control path (ISC path) 23 is provided with the throttle valve 3 downstream, so as to bypass the throttle valve 3. Although not shown, an idle speed control valve (ISCV) may be provided in the ISC path 23.

In the fifth exemplary embodiment, two throttle valves 3, 33 are disposed in series. When one of the valves is provided with the ISC path, the other valve is subjected to the control that constitutes the characteristic of the invention. Also, because both PCV paths 7 are opened downstream of the throttle valve 33 which is located upstream, the possibility that any HCs flow outside through the air intake port of the air cleaner 8 is further reduced.

Figure 8:
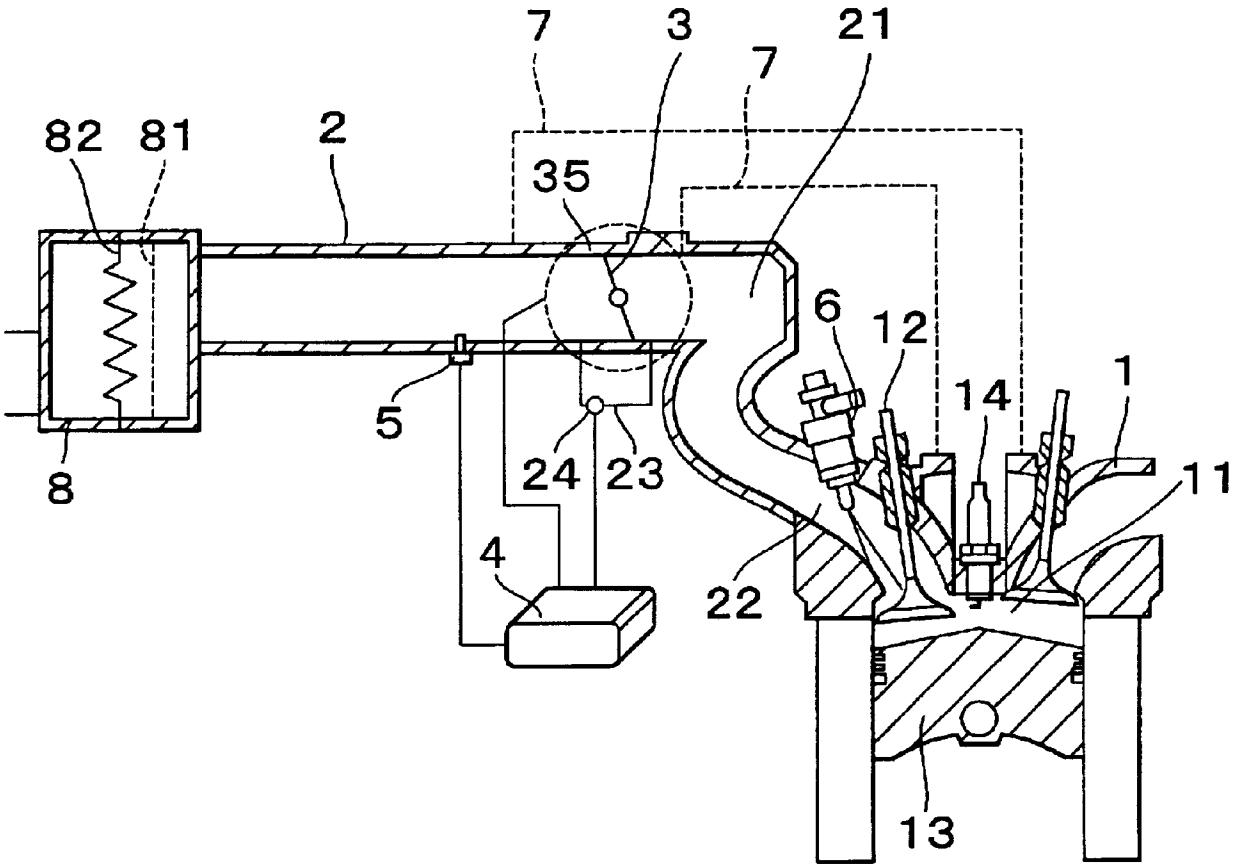
FIG. 8 is a sectional view showing the structure of a hydrocarbons emission preventive apparatus according to the sixth exemplary embodiment.

In the sixth exemplary embodiment of the invention shown in FIG. 8, in addition to that the ISC path 23 for bypassing the throttle valve 3 is provided, an idle speed control valve (ISCV) 24 is interposed in the ISC path 23. In this case, the ISCV 24 is opened at the timing when the throttle valve 3 is opened by the ECU 4 after the engine is stopped, and it is able to be fully closed at the same timing when the throttle valve 3 is fully closed by the ECU 4. Accordingly, it is possible to avoid sticking due to the polymerization of the HCs adhered to the ISCV 24. In addition, when both the throttle valve 3 and ISCV 24 are fully closed, it is possible to prevent the HCs from passing the ISC path 23 and diffusing upstream of the intake pipe 2.

Figure 9:
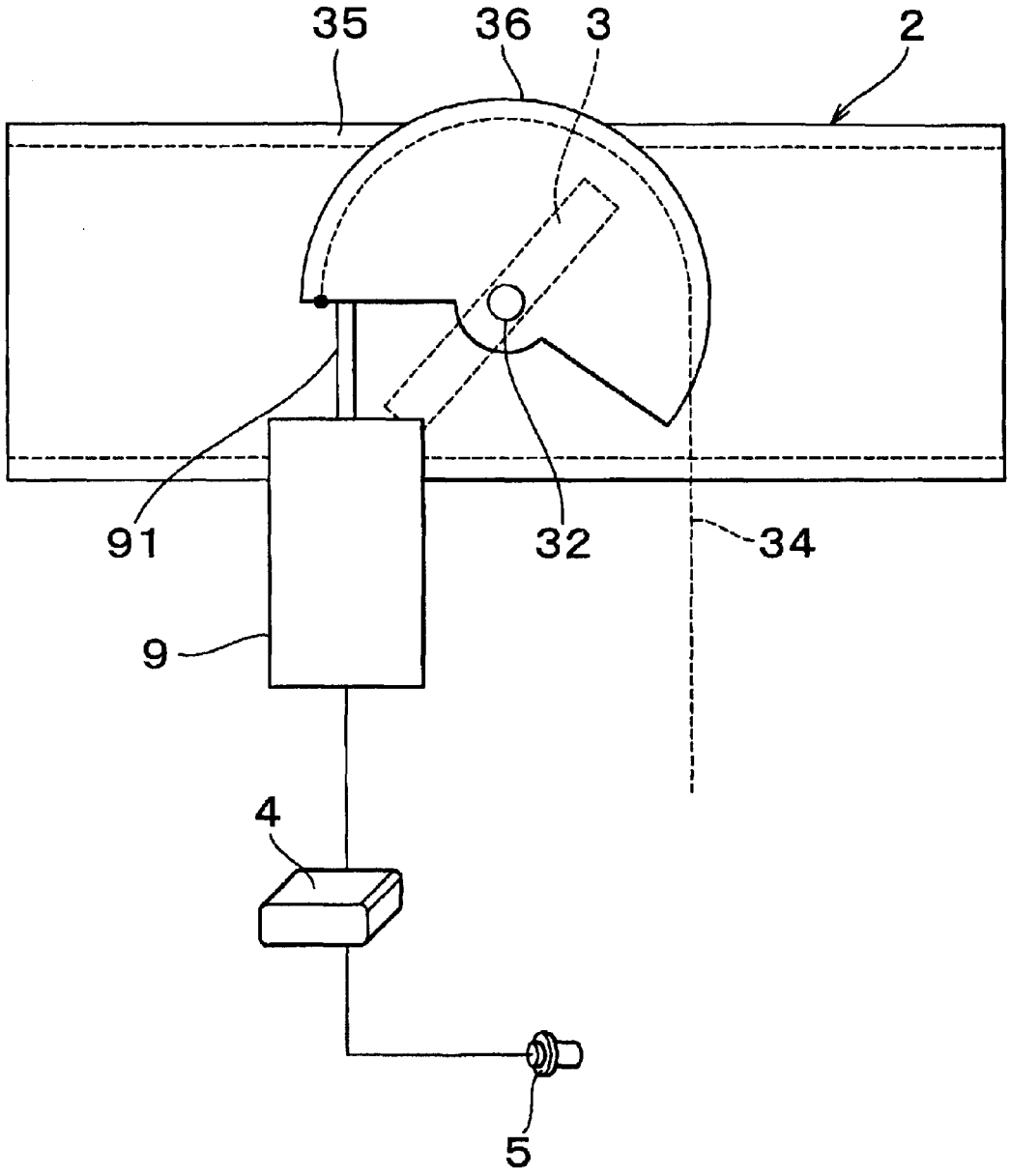
FIG. 9 is a sectional view showing the structure of a hydrocarbons emission preventive apparatus according to the seventh exemplary embodiment.

FIG. 9 shows the structure of a hydrocarbons preventive apparatus according to the seventh exemplary embodiment of the invention. A throttle holder 36 of a substantial semi-spherical in form is attached to a rotation shaft 32 of the throttle valve 3 provided in the intake pipe 2. A throttle wire 34 is wound on the throttle holder 36, with one end of the throttle wire 34 fixed to the throttle holder 36. The throttle valve 3 is urged toward the valve-close side by a spring (not shown). The throttle wire 34 is provided to control the throttle valve 3 to be opened/closed, responding to the operation by a driver or by means of an actuator (not shown) of a control apparatus. A solenoid actuator 9 is attached to the throttle body 35, corresponding to a position occupied by the throttle holder 36 when the throttle valve 3 is fully closed, and a tip of an output shaft 91 of the solenoid actuator 9 is engaged with one side of the throttle holder 36. The solenoid actuator 9 is controlled by the ECU 4.

In the seventh exemplary embodiment, when the solenoid actuator 9 is urged by a command of the ECU 4 at a time when the engine 1 is stopped, the output shaft 91 protrudes to rotate the shaft 32 of the throttle valve 3 together with the throttle holder 36. Owing to this, the throttle valve 3 is opened by a predetermined degree of opening. Further, a time has elapsed and when the detected value of the intake temperature sensor 5 becomes below the predetermined value, the ECU 4 detects it and stops the power supply to the solenoid actuator 9 so as to retreat the output shaft 91 to fully close the throttle valve 3. Thus, in the seventh exemplary embodiment also, a similar effect as in the first exemplary embodiment can be obtained.

Figure 10:
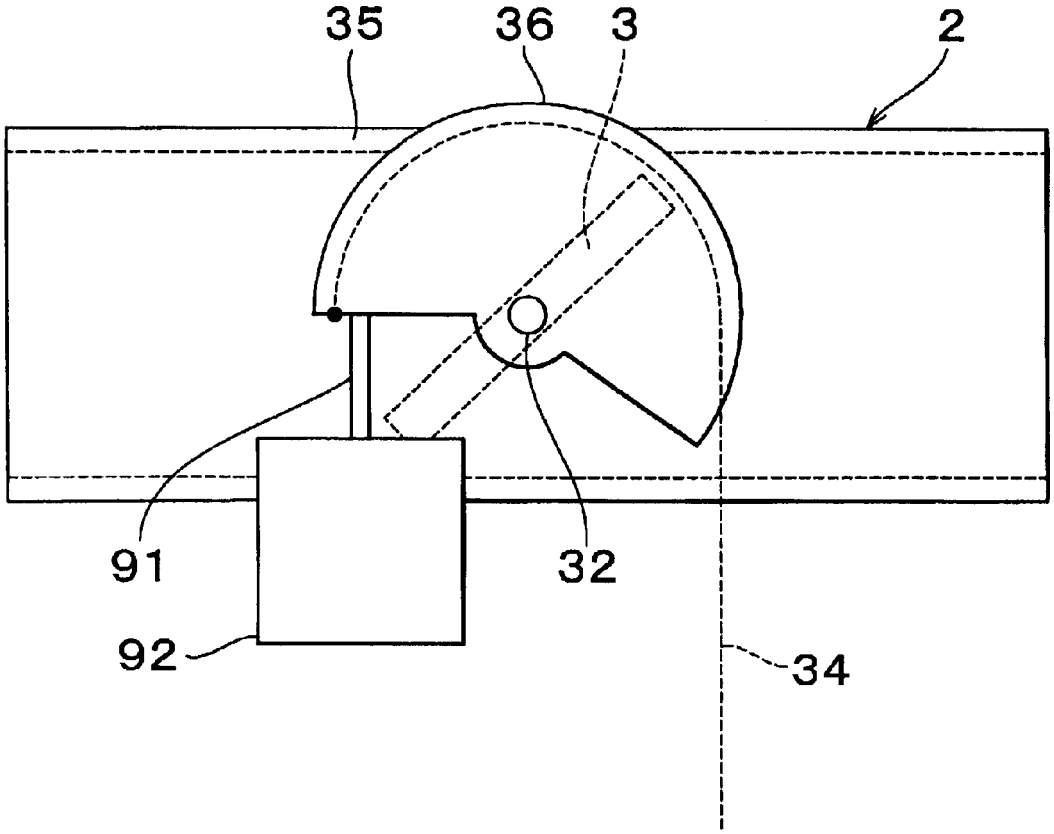
FIG. 10 is a sectional view showing the structure of a hydrocarbons emission preventive apparatus according to the eighth exemplary embodiment.

In the eighth exemplary embodiment of the invention shown in FIG. 10, in place of the solenoid actuator 9 in the seventh exemplary embodiment, a thermo-wax actuator 92 is used which is responsive to a high temperature at or higher than a predetermined value so as to cause the output shaft 91 to protrude. That is to say, the thermo-wax actuator 92 automatically responses to a temperature of a part of the engine 1, correlated to a temperature of the throttle valve 3. The thermo-wax actuator 92 is structured such that it is attached to the throttle body 35 to absorb the heat transmitted from the intake pipe 2. Its operation temperature is preset to a value near the maximum temperature of the intake pipe 2 when the engine 1 is in operation.

Accordingly, when the engine 1 is stopped and in a state of dead soak, the output shaft 91 of the thermo-wax actuator 92 protrudes due to the heat therefrom. Therefore, even when the engine 1 is stopped, the output shaft prevents the throttle valve 3 from closing and causes it to have a predetermined degree of opening. After a time has passed after the point of time when the engine 1 is stopped, the temperature of the throttle body 35 decreases to a temperature where a polymerization reaction of the HCs does not occur. At this time, because the thermo-wax actuator 92 is also compressed and causes the output shaft 91 to retreat, the throttle valve 3 is fully closed to seal the HCs in the surge tank 21 side (refer to FIG. 1A).

Figure 11:
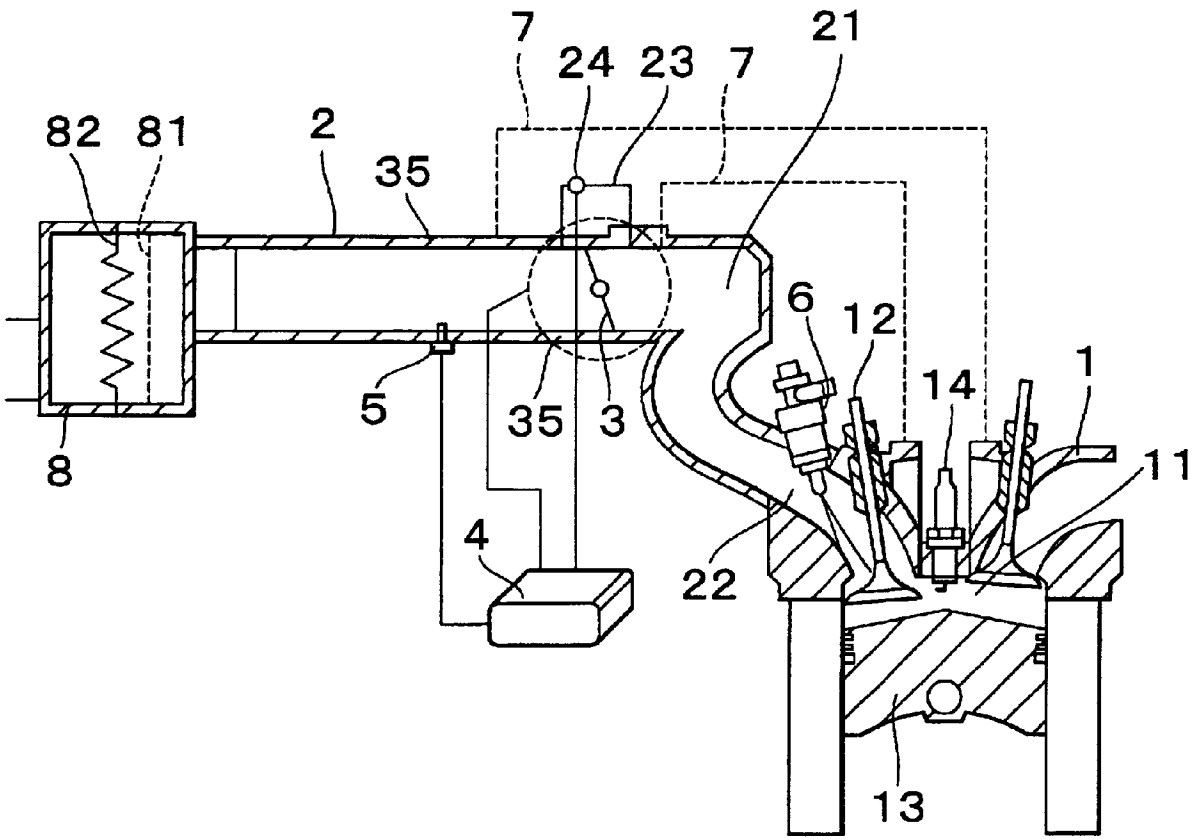
FIG. 11 is a sectional view showing the structure of a hydrocarbons emission preventive apparatus according to the ninth exemplary embodiment.

FIG. 11 shows the structure of a hydrocarbons preventive apparatus according to the ninth exemplary embodiment of the invention. Also, in this case, as in the case of the sixth exemplary embodiment shown in FIG. 8, the ISC path 23 that bypasses the throttle valve 3 and the ISCV 24 are provided. However, it is different in a point that they are positioned above the throttle valve 3.

In the ninth exemplary embodiment, even in a case where the throttle valve 3 can not be opened while the engine 1 is stopped due to some reasons, by opening the ISCV 24 for a predetermined period of time in place of the throttle valve 3, it is possible for the air to flow within the intake pipe 2. Also, because the HCs are heavier than the air, it is possible to prevent the HCs from flowing out upstream through the ISCV 24 together with the air. Because, the air mainly flows upstream while decreasing the temperature within the intake pipe 2 in a short period of time, it is possible to prevent the HCs adhered to the gap between the throttle valve 3 and the throttle body 35 from being polymerized under a high temperature. In this case, it is desirable to close the ISCV 24 after a predetermined period of time has passed.

Further, like the throttle valve 3 in the aforementioned exemplary embodiments, it is desirable that the ISCV 24 is also automatically stopped by the ECU 4 after the internal combustion engine is controlled. Also, in order to reduce the power consumption after the stopping of the engine, the solenoid actuator 9 shown in FIG. 9 or the thermo-wax actuator 92 shown in FIG. 10 may control opening/closing the ISCV 24.

As in the aforementioned exemplary embodiments, by providing a hydrocarbons adsorbent like the activated carbon layer 81 upstream of the intake path of the internal combustion engine, i.e., to the air cleaner 8, the HCs, which leak outside through the gap or the like of the periphery of the closed throttle valve 3, is adsorbed by the absorbent, and it is possible to reliably prevent the HCs from being emitted. Owing to this, it is possible to enhance the efficiency of the hydrocarbons emission preventive apparatus. According to the effect thereof, it is possible to reduce the amount of the adsorbent such as activated carbon which is used for that. Accordingly, it is possible to reduce the air resistance due to the adsorbent so as to enhance the operating efficiency of the internal combustion engine. The adsorbent may be disposed upstream of the throttle valve 3, at a place other than one the air cleaner 8.

Finally, the ECU 4 may be regarded to be a controller of the invention. The motor 35 may be regarded to be a first operating apparatus of the invention. The valve drive circuit 42, the solenoid actuator 9 and the thermo-wax actuator 92 may be regarded to be a second operating apparatus of the invention. The idle speed control path 23 may be regarded to be a bypass of the invention. Further, the idle speed control valve 24 may be regarded to be a valve provided in the bypass of the invention. Measurements, that are referred to in the invention, include detection and estimation.

The word "Prevent" in the invention includes the words "suppress", "inhibit", and "impede".

The ECU 4 of the illustrated exemplary embodiments is implemented as one or more programmed general purpose computers. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more less or only a single element, are also within the spirit and scope of the invention.

What is claimed is:

1. A hydrocarbon emission prevention apparatus in an intake system of an internal combustion engine, comprising:

a first throttle valve provided in an intake path of the internal combustion engine; and a controller that opens the first throttle valve after stopping the internal combustion engine until a predetermined condition is met where no polymerization occurs by the hydrocarbons on at least one of the first throttle valve and the intake path surrounding the first throttle valve and that closes the first throttle valve when the predetermined condition is met.

2. The apparatus according to claim 1, further comprising:

a measuring device that obtains a temperature of the first throttle valve, wherein the controller determines that the predetermined condition is met when the detected temperature is decreased to a predetermined value.

3. The apparatus according to claim 2, wherein the measuring device is a detector provided in a peripheral portion of the first throttle valve, and the detector directly detects the temperature of the first throttle valve.

4. The apparatus according to claim 2, wherein the measuring device is a detector that detects the temperature of intake air of the internal combustion engine to estimate the temperature of the first throttle valve.

5. The apparatus according to claim 2, wherein the predetermined value is a temperature based on a polymerization initiation temperature of the hydrocarbons.

6. The apparatus according to claim 1, further comprising:

a bypass that bypasses the first throttle valve; and a valve provided in the bypass, wherein the controller opens and closes the valve provided in the bypass in the same manner as the first throttle valve after stopping the internal combustion engine.

7. The apparatus according to claim 6, wherein the controller is an electronic control unit that controls the valve provided in the bypass to be automatically opened/closed.

8. The apparatus according to claim 1, wherein the controller is an electronic control unit that controls the first throttle valve to be automatically opened/closed.

9. The apparatus according to claim 1, wherein the controller is provided with a first actuator that controls the first throttle valve to be opened/closed while operating the internal combustion engine and a second actuator that controls the first throttle valve to be opened/closed after stopping the internal combustion engine.

10. The apparatus according to claim 9, wherein the second actuator is a solenoid actuator controlled by the controller.

11. The apparatus according to claim 9, wherein the second actuator that automatically opens/closes the first throttle valve in response to a temperature of a part of the internal combustion engine.

12. The apparatus according to claim 11, wherein the second actuator is a thermo-wax actuator attached to a throttle body.

13. The apparatus according to claim 1, further comprising:

a second throttle valve disposed in series with the first throttle valve in the intake path;

a bypass that bypasses the first throttle valve; and a valve provided in the bypass, wherein the second throttle valve does not have the bypass, and the controller controls the second throttle valve to be opened/closed after stopping the internal combustion engine.

14. The apparatus according to claim 13, wherein the second throttle valve is disposed upstream of the first throttle valve, and the controller closes the second throttle valve earlier than the first throttle valve after stopping the internal combustion engine.

15. The apparatus according to claim 1, further comprising:

an adsorbent that adsorbs the hydrocarbons and that is disposed upstream of the first throttle valve in the intake path.

16. The apparatus according to claim 15, wherein the adsorbent has an activated carbon layer.

17. The apparatus according to claim 15, wherein the adsorbent is mounted within an air cleaner disposed in the intake path.

18. The apparatus according to claim 15, wherein the controller closes the first throttle valve before the hydrocarbons reach the adsorbent.

19. The apparatus according to claim 1, wherein the controller determines that the predetermined condition is met when a predetermined period of time has passed after stopping the internal combustion engine and closes the first throttle valve, and wherein the predetermined period of time is not longer than 60 minutes.

20. The apparatus according to claim 1, wherein the predetermined condition is a condition where the hydrocarbons on at least one of the first throttle valve and the intake path surrounding the first throttle valve do not polymerize.

21. A method for preventing emission of hydrocarbons in an intake path of an internal combustion engine, comprising:

opening a throttle valve provided in the intake path after stopping the internal combustion engine;

keeping the throttle valve open until a predetermined condition is met where no polymerization occurs by the hydrocarbons on at least one of the throttle valve and the intake path surrounding the throttle valve; and closing the throttle valve when the predetermined condition is met.

* * * * *